US012492885B2

(12) United States Patent
Fowler

(10) Patent No.: US 12,492,885 B2
(45) Date of Patent: Dec. 9, 2025

(54) SYSTEMS AND METHODS FOR PROVIDING A MOBILE EXPANDABLE BALLISTIC BARRIER APPARATUS

(71) Applicant: GOLDENEYE DEFENSE LLC, Newnan, GA (US)

(72) Inventor: Clayton Erik Fowler, Newnan, GA (US)

(73) Assignee: GOLDENEYE DEFENSE LLC, Newnan, GA (US)

( * ) Notice: Subject to any disclaimer, the term of this patent is extended or adjusted under 35 U.S.C. 154(b) by 0 days.

(21) Appl. No.: 18/979,445

(22) Filed: Dec. 12, 2024

(65) Prior Publication Data

US 2025/0189277 A1 Jun. 12, 2025

Related U.S. Application Data

(60) Provisional application No. 63/608,994, filed on Dec. 12, 2023.

(51) Int. Cl.
*F41H 5/14* (2006.01)

(52) U.S. Cl.
CPC ..... *F41H 5/14* (2013.01)

(58) Field of Classification Search
CPC ..... F41H 5/14; F41H 5/06; F41H 5/08
See application file for complete search history.

(56) References Cited

U.S. PATENT DOCUMENTS

| | | | | |
|---|---|---|---|---|
| 11,280,588 | B1 * | 3/2022 | Esquilin-Mangual | F41H 5/24 |
| 2017/0218683 | A1 * | 8/2017 | Shanahan | E05D 15/264 |
| 2018/0073841 | A1 * | 3/2018 | DeKort | F41H 5/08 |
| 2020/0284553 | A1 * | 9/2020 | Esquilin-Mangual | F41H 5/013 |
| 2020/0393216 | A1 * | 12/2020 | Maji | F41H 5/02 |

* cited by examiner

*Primary Examiner* — J. Woodrow Eldred
(74) *Attorney, Agent, or Firm* — CHRISTOPHER J CHAN IP LAW LLC

(57) ABSTRACT

Embodiments of the disclosure can provide systems and methods for providing a mobile expandable ballistic barrier apparatus. The apparatus can include a trailing panel with a front side, an opposing rear side, a trailing side, and a leading side; a trailing frame with one or more wheels, the trailing frame configured to support the trailing side of the trailing panel; a leading panel comprising a respective front side, an opposing rear side, a trailing side, and a leading side; a leading frame with one or more wheels, the leading frame configured to support the leading side of the leading panel; and one or more intermediate panels, each of the one or more intermediate panels comprising a respective front side, an opposing rear side, an leading side, and a trailing side.

10 Claims, 11 Drawing Sheets

SYSTEMS AND METHODS FOR PROVIDING A MOBILE EXPANDABLE BALLISTIC BARRIER APPARATUS

RELATED APPLICATION

The present application claims priority to U.S. Provisional Ser. No. 63/608,994, titled "SYSTEM AND METHOD FOR A MOBILE EXPANDABLE BALLISTIC BARRIER", filed Dec. 12, 2023, the contents of which are incorporated by reference.

FIELD OF DISCLOSURE

The present disclosure is related to security devices, and more particularly to, systems and methods for providing a mobile expandable ballistic barrier apparatus.

BACKGROUND

Conventional portable or mobile expandable ballistic barrier solutions can often require internal, external, or separately provided winch or lifting equipment for setup and breakdown.

In a related technology, a system and method for providing a mobile mission kit (MMK) can provide a barrier solution that includes one or more panels that can be manually extended from a mobile crate, and the user has an option to install a motorized deployment method dependent upon application. Another related technology, a system and method for providing a deployable perimeter security apparatus (also known as "RIOT") can provide a barrier solution that includes one or more panels that can be manually extended from a mobile frame.

Other conventional solutions can be time consuming to set up and deploy, while in many instances, these solutions may not be as versatile, durable, or otherwise effective in a variety of situations.

BRIEF SUMMARY OF DISCLOSURE

Embodiments of the disclosure can provide systems and methods for providing a mobile expandable ballistic barrier apparatus. Certain embodiments of the disclosure can provide a mobile expandable ballistic barrier apparatus. In at least one embodiment of the disclosure, a mobile expandable ballistic barrier apparatus can include one or more telescoping fence like panels that open or otherwise deploy into a protective barrier relatively quickly, such as within seconds, upon arriving at a designated location. The mobile expandable ballistic barrier apparatus (also referred to as "QRF") can be manipulated by or transported via one or more wheels through a standard size residential and/or commercial door. After being manipulated or otherwise transported through the door, the mobile expandable ballistic barrier apparatus can be opened or otherwise deployed such that one or more panels can telescope into the protective barrier. Thus, one or more users, such as a SWAT team, can enter a hallway, corridor, or building through a door with the mobile expandable ballistic barrier apparatus, and expand one or more panels into a protective barrier to protect themselves in the hallway, corridor, or building while they clear and/or evacuate the adjacent area as they move into the hallway, corridor, or building.

In one embodiment, a mobile expandable ballistic barrier apparatus can include a trailing panel comprising a respective front side, an opposing rear side, a trailing side, and a leading side; a trailing frame with one or more wheels, the trailing frame configured to support the trailing side of the trailing panel; a leading panel comprising a respective front side, an opposing rear side, a trailing side, and a leading side; a leading frame with one or more wheels, the leading frame configured to support the leading side of the leading panel; and one or more intermediate panels, each of the one or more intermediate panels comprising a respective front side, an opposing rear side, a leading side, and a trailing side, wherein a front side of a first intermediate panel mounts to the opposing rear side of the trailing panel, and the opposing rear side of a second intermediate panel mounts to a front side of the leading panel; wherein, in a storage or non-deployed position, the respective leading sides and the trailing sides of the leading panel, the trailing panel, and the one or more intermediate panels are substantially parallel and coplanar with each other.

In one aspect of the embodiment, in a deployed position, the leading frame and the trailing frame cooperate with each other to facilitate the telescoping of the one or more intermediate panels and leading panel away from the trailing panel.

In one aspect of the embodiment, the apparatus can also include a trailing handle operable to permit the trailing frame and trailing panel to be manually positioned via a force on the trailing handle.

In one aspect of the embodiment, the apparatus can also include a leading handle operable to permit the leading frame and leading panel to be manually positioned via a force on the leading handle.

In one aspect of the embodiment, the first intermediate panel and second intermediate panel are operable to slide along one or more frame guides respectively associated with the trailing panel and leading panel.

In one aspect of the embodiment, the one or more wheels of the leading panel are mounted on a swivel-type mechanism.

In one aspect of the embodiment, the apparatus can also include at least one panel with a translucent or clear material to facilitate viewing through the panel from at least one side.

In one aspect of the embodiment, each of the respective front sides of the trailing panel, the first intermediate panel, the second intermediate panel, and the leading panel comprise a ballistics resistant material.

In one embodiment, a method for installing a mobile expandable ballistic barrier apparatus can be provided. The method can include positioning an apparatus with a trailing panel comprising a respective front side, an opposing rear side, a trailing side, and a leading side; a trailing frame with one or more wheels, the trailing frame configured to support the trailing side of the trailing panel; a leading panel comprising a respective front side, an opposing rear side, a trailing side, and a leading side; a leading frame with one or more wheels, the leading frame configured to support the leading side of the leading panel; and one or more intermediate panels, each of the one or more intermediate panels comprising a respective front side, an opposing rear side, an leading side, and a trailing side, wherein a front side of a first intermediate panel mounts to the opposing rear side of the trailing panel, and the opposing rear side of a second intermediate panel mounts to a front side of the leading panel; wherein, in a storage or non-deployed position, the leading sides and the trailing sides of the leading panel, the trailing panel, and the one or more intermediate panels are substantially parallel and coplanar with each other. The method can include sliding the leading panel away from the trailing panel, wherein the leading frame and the trailing frame cooperate with each other to facilitate the telescoping of the one or more intermediate panels and leading panel away from the trailing panel; sliding the second intermediate panel away from the trailing panel; and sliding the first intermediate panel away from the trailing panel, to form a protective barrier.

BRIEF DESCRIPTION OF THE DRAWINGS

The detailed description is set forth with reference to the accompanying drawings. The drawings are provided for purposes of illustration only and merely depict exemplary embodiments of the disclosure. The drawings are provided to facilitate understanding of the disclosure and shall not be deemed to limit the breadth, scope, or applicability of the disclosure. In the drawings, the left-most digit(s) of a reference numeral may identify the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

This disclosure relates to, among other things, systems and methods for providing a mobile expandable ballistic barrier apparatus. In one embodiment, a mobile expandable ballistic barrier apparatus can include a trailing panel comprising a respective front side, an opposing rear side, a trailing side, and a leading side; a trailing frame with one or more wheels, the trailing frame configured to support the trailing side of the trailing panel; a leading panel comprising a respective front side, an opposing rear side, a trailing side, and a leading side; a leading frame with one or more wheels, the leading frame configured to support the leading side of the leading panel; and one or more intermediate panels, each of the one or more intermediate panels comprising a respective front side, an opposing rear side, a leading side, and a trailing side, wherein a front side of a first intermediate panel mounts to the opposing rear side of the trailing panel, and the opposing rear side of a second intermediate panel mounts to a front side of the leading panel; wherein, in a storage or non-deployed position, the respective leading sides and the trailing sides of the leading panel, the trailing panel, and the one or more intermediate panels are substantially parallel and coplanar with each other.

In one or more embodiments, the systems and methods described herein may improve upon conventional solutions where unlike other fence based systems that have to be packaged or crated, then shipped, opened at site, assembled, packaging debris removed to make room for work area, and connected to other similar units to create a protective barrier. The present systems, methods, and associated apparatus can provide technical solutions to ship an apparatus ready for use which can be immediately activated or otherwise manually deployed at destination locations and sites.

Figure 1:
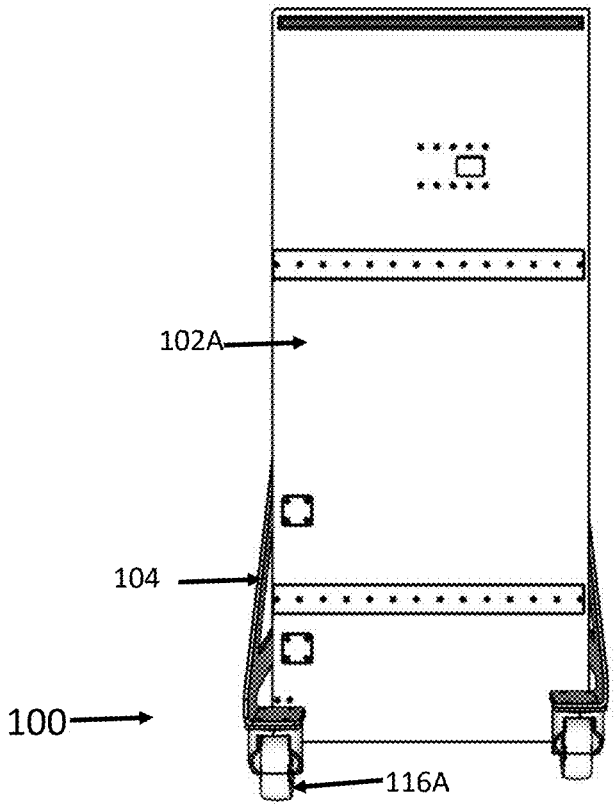
FIG. 1 illustrates a front view of an example mobile expandable ballistic barrier apparatus in a storage or non-deployed configuration, according to an example embodiment of the disclosure.
Figure 2:
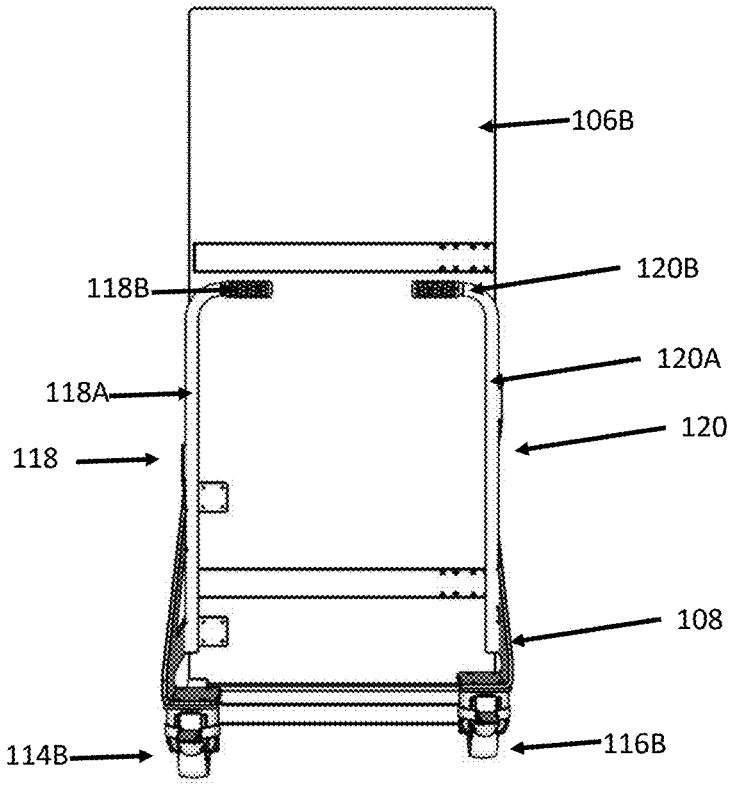
FIG. 2 illustrates a rear view of the example apparatus shown in FIG. 1, in a storage or non-deployed configuration.
Figure 3:
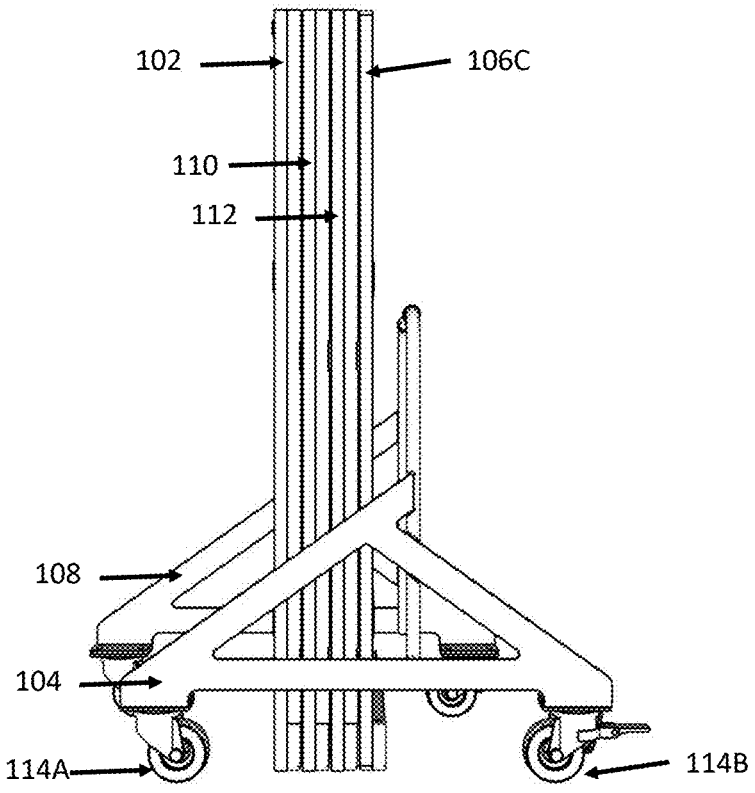
FIG. 3 illustrates a side view of the example apparatus shown in FIGS. 1-2, in a storage or non-deployed configuration.

FIGS. 1-3 illustrate views of an example mobile expandable ballistic barrier apparatus in a storage or non-deployed configuration, according to an example embodiment of the disclosure. FIG. 1 illustrates a front view of the example apparatus, and FIG. 2 illustrates a rear view of the example apparatus shown in FIG. 1, in a storage or non-deployed configuration. FIG. 3 illustrates a side view of the example apparatus shown in FIGS. 1-2.

As shown in FIGS. 1-3, in one or more embodiments, the apparatus 100 can include a trailing panel 102, a trailing frame 104, a leading panel 106, a leading frame 108, and one or more intermediate panels, such as 110, 112. Each of the trailing panel 102, a leading panel 106, and one or more intermediate panels 110, 112 can be rectangular shaped and about the same dimensions, for example, about 80 inches (2.03 meters) high, 36 inches (0.91 meters) wide, and 2 inches (0.05 meters) deep. Each of the panels shown in FIGS. 1-3 as 102, 106, 110, 112 can include a respective front side (also known as a "threat side"), such as 102A, 106A, 110A, 112A, an opposing rear side (also known as a "safe side"), such as 102B, 106B, 110B, 112B, a trailing side such as 102C, 106C, 110C, 112C, and a leading side such as 102D, 106D, 110D, 112D. One skilled in the art will recognize that the panels 102, 106, 110, 112 can be of various shapes, sizes and/or dimensions.

The trailing frame 104 and the leading frame 108 can each support a respective trailing panel 102 and leading panel 106 with one or more wheels 114A, 114B, 116A, 116B. The trailing frame 104 can mount to and support the trailing side 102C of the trailing panel 102, and the leading frame 108 can mount to and support the leading side 106D of the leading panel 106. For example, as shown on a front side or threat side, a metal plate with fasteners can mount through a panel to mount to a corresponding metal plate on the opposing rear side or safe side of the panel, thus creating a "metal plate sandwich". The trailing frame 104 and leading frame 108 can be triangular-shaped with a respective wheel 114A, 114B, 116A, 116B mounted at the respective lower corners of each frame 104, 108. The trailing frame 104 and leading frame 108 can be approximately the same dimensions, for example, about 50 inches (1.27 meters) high, 36 inches (0.91 meters) wide, and 3 inches (0.08 meters) thick. The one or more wheels 114A, 114B, 116A, 116B in the embodiment shown can be 6 inches (0.15 meters) in diameter. The one or more wheels 114A, 114B, 116A, 116B can be casters, pneumatic wheels, solid rubber feet, or any other device that facilitates mobility for the apparatus along a surface, such as the ground. One skilled in the art will recognize that the frames 104, 108 and one or more wheels 114A, 114B, 116A, 116B can be of various configurations, sizes and/or dimensions.

As shown, the apparatus 100 can also include a trailing handle 118 and a leading handle 120. Each of the trailing handle 118 and leading handle 120 can be inverted L-shaped. An elongated portion 118A, 120A of each handle 118, 120 can mount to a respective upper portion 122, 124 of the trailing frame 104 and leading frame 108, on the rear sides of the trailing panel 102 and leading panel 106. In the embodiment shown, the handles 118, 120 can be mounted in a substantially vertical or horizontal position with a spaced apart distance of approximately 9 inches (0.23 meters) from the trailing panel 102 and leading panel 106. A relatively shorter portion 118B, 120B of each handle 118, 120 can provide a manual grip for a user to manipulate the respective handle 118, 120 when deploying the apparatus 100 from a storage or non-deployed position, or vice versa, when storing the apparatus 100 from a deployed position. The trailing handle 118 and leading handle 120 can be approximately the same dimensions, for example, about 45 inches (1.14 meters) high, 3 inches (0.08 meters) wide, and 3 inches (0.08 meters) thick. One skilled in the art will recognize that the handles 118, 120 can be of various shapes, sizes and/or dimensions.

The first intermediate panel 110 can mount to the trailing panel 102, wherein a front side 110A of the first intermediate panel 110 mounts to the opposing rear side 104B of the trailing panel 102. A guide mechanism 126 can facilitate the first intermediate panel 110 sliding or telescoping with respect to the trailing panel 102, from the storage or non-deployed position to the deployed position. In the storage or non-deployed position, the leading side 110D of the first intermediate panel 110 is substantially parallel and coplanar with the leading side 102D of the trailing panel 102, and the trailing side 110C of the first intermediate panel 110 is substantially parallel and coplanar with the trailing side 102C of the trailing panel 102.

The second intermediate panel 112 can mount to the leading panel 106, wherein a front side 112A of the second intermediate panel 112 mounts to the opposing rear side 106B of the leading panel 106. A guide mechanism 128 can facilitate the second intermediate panel 110 sliding or telescoping with respect to the leading panel 106, from the storage or non-deployed position to the deployed position. In the storage or non-deployed position, the leading side 112D of the second intermediate panel 112 is substantially parallel and coplanar with the leading side 106D of the leading panel 106, and the trailing side 112C of the second intermediate panel 112 is substantially parallel and coplanar with the trailing side 106C of the leading panel 106. Thus, in the storage or non-deployed position, the one or more intermediate panels 110, 112 are substantially parallel and coplanar with each other.

Figure 7:
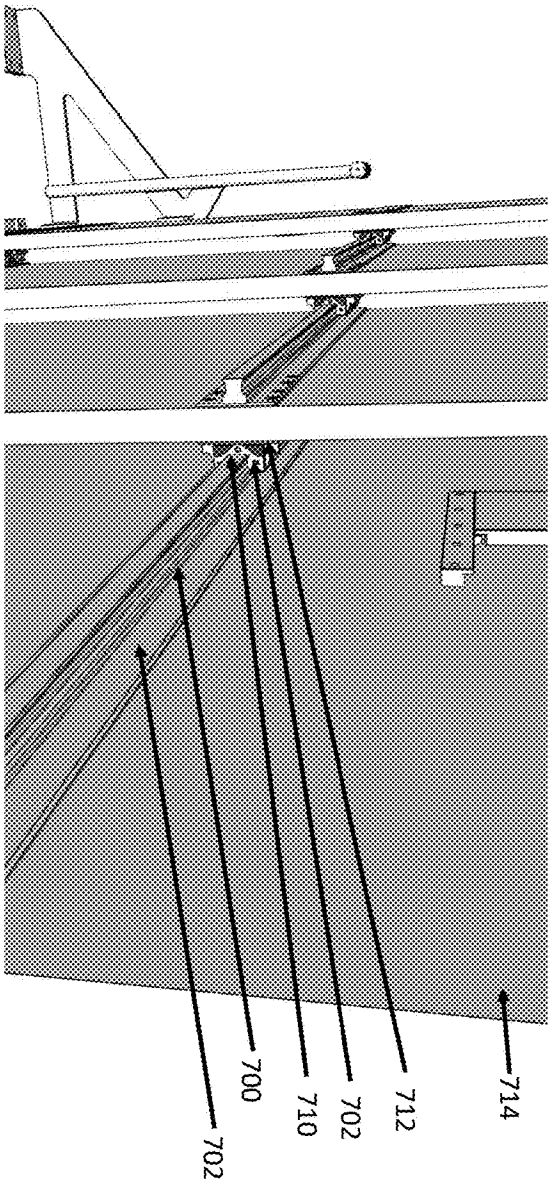
FIG. 7 illustrates a detailed view of an example guide mechanism of the apparatus shown in FIGS. 1-6, according to an example embodiment of the disclosure.

The guide mechanisms 126, 128 shown in FIGS. 1-3 can be a cantilever track mechanism shown in detail in FIG. 7. One skilled in the art will recognize that any number of technologies can be used to connect adjacent panels as well as the first intermediate panel 110 to the trailing panel 102, and the second intermediate panel 112 to the leading panel 106. Suitable technologies can include a cantilever track mechanism; a hinged, ball bearing, sliding pull-out mechanism; any other telescoping, articulating, bi-fold, and/or mechanical arm extension; or any other mechanical devices that can facilitate a desired sliding, telescoping and/or articulating action for any number of specific needs or applications. In any instance, a desired technology can be selected and mounted to each panel, allowing for the connection to other adjacent panels, which permits connected adjacent panels to slide, telescope and/or articulate with respect to each other as well as the apparatus 100 and/or frames 104, 108. In certain instances, a guide mechanism 126, 128 can be constructed from metal, steel, aluminum, aircraft aluminum, fiber resin polymer, or any other material or combinations thereof disclosed herein for a desired need or application.

Figure 4:
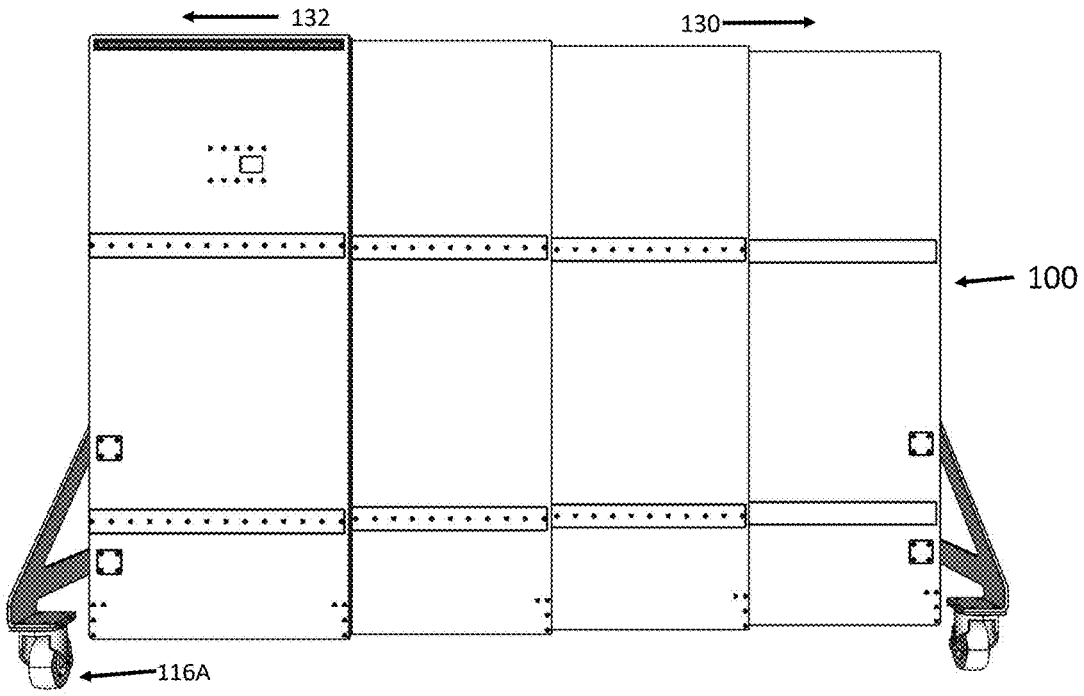
FIG. 4 illustrates a front view of the example apparatus shown in FIGS. 1-3, in an activated or deployed configuration, according to an example embodiment of the disclosure.
Figure 5:
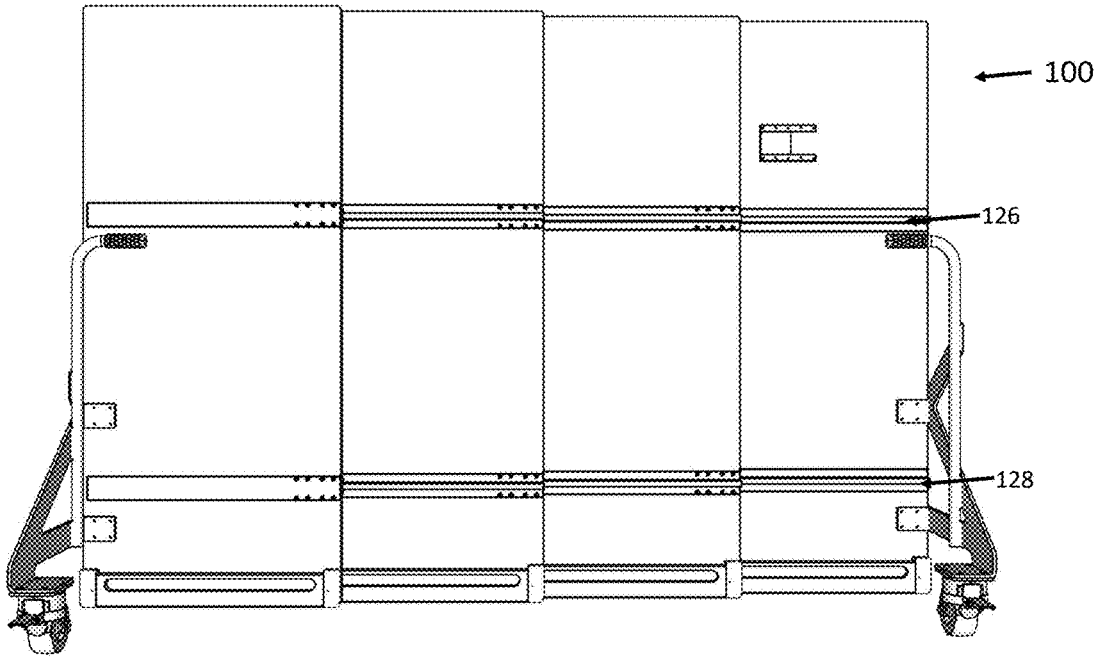
FIG. 5 illustrates a rear view of the example apparatus shown in FIG. 4, in an activated or deployed configuration.
Figure 6:
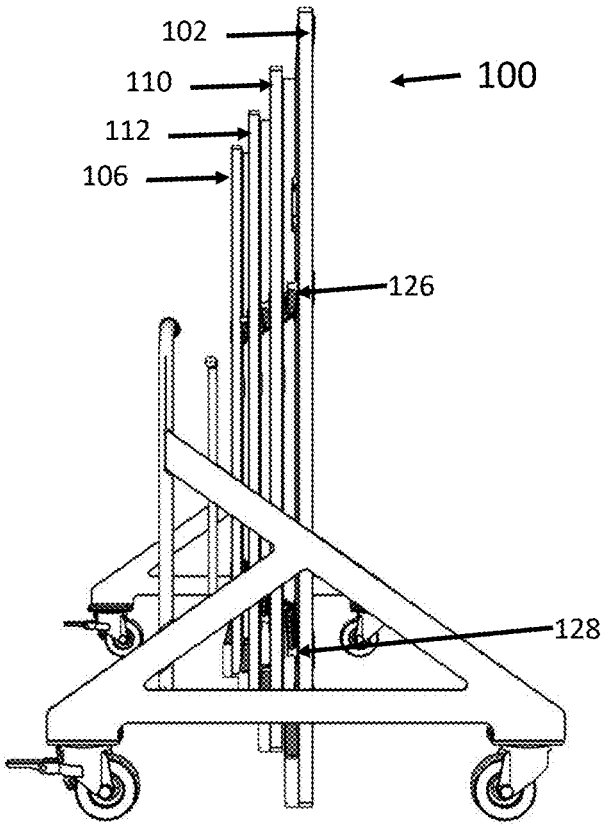
FIG. 6 illustrates a side view of the example apparatus shown in FIGS. 4-5, in an activated or deployed configuration.

Generally, each of the panels can be a relatively thin, rectangular-shaped component. When the panels are connected to each other, the panels can be telescoped and/or articulated into a storage or non-deployed configuration, for example, as shown in FIGS. 1-3, and the telescoped and/or articulated panels can be arranged into a protective barrier when activated or deployed as shown in FIGS. 4-6. To maintain the position and/or orientation of each panel with respect to an adjacent connected panel, one or more locking mechanisms can be implemented with the apparatus 100. Example locking mechanisms can include, but are not limited to, a stopper-type device that can be depressed or otherwise manipulated by a user, such as one or more pulled or inserted tethered collar pins, or a pull down lever for each panel.

In some instances, an exterior facing side of a panel, such as a front side 102A of the trailing panel 102 may be different than the opposing rear side 102B of the panel 102. That is, a different material may be used on one side 102A of the trailing panel 102, or a different and separate panel component can be used, than on the opposing or rear side 102B of the trailing panel 102. In this manner, an exterior facing side of a panel, such as on a front side 102A of the trailing panel 102 can be "skinned" or otherwise customized for any desired need or purpose. Alternatively, a material and/or coating may be selected for a panel that appears to be translucent or clear to facilitate viewing through the panel from one side, but from the opposing side, the panel may be relatively opaque and may not facilitate viewing through the panel from the opposing side. In any instance, suitable materials for an exterior facing side of a panel, such as on a front side 102A of the trailing panel 102, can include, but not limited to, polyurea, aluminum, aircraft aluminum, laminates, wood, veneers, fiber polymer resins, non-woven materials, kevlar, meta materials, Lexam, thermoplastic polyethylene polymer (TPP), UHMWPE (ultra high molecular weight polyethylene), any other type of material disclosed herein, or any combination thereof for any specific need or application. In at least one embodiment, a suitable combination material and coating to facilitate viewing through the panel from one side, but from the opposing side, the panel may be relatively opaque and may not facilitate viewing through the panel from the opposing side, can be, for example, a ballistic, transparent acrylic, polycarbonate or glass can be a suitable material for a panel, and an automotive or commercial window film, such as a 3M limo or mirror tint for a coating on the front or threat side of the panel. In any instance, in certain embodiments, the apparatus shown in FIGS. 1-6 can include one or more panels that are generally transparent with a ballistic-resistant acrylic material, and on the front (or threat) side, limo-type tint window film or mirror tint window film can be applied to disorient persons or attackers approaching from the front (or threat side) and providing one or more users, such as law enforcement personnel, on the rear or opposing side, or safe side, a view through the panel.

The frames 104, 108 can be made from any number of relatively durable materials including, but not limited to, aluminum, aircraft aluminum, steel, fiber resin polymer (FRP), plastic, titanium, meta materials, TPP, fiberglass resin polymers, kevlar, carbon fiber composite, acrylic, steel plate, polyurea coating, Lexam, UHMWPE, concrete, rubber, ballistic or projectile resistant material including those that meet or exceed NIJ and UL-752 ballistic resistant material test requirements (or greater protection levels), anti-climb or anti-scale fencing, combinations of anti-climb or anti-scale fencing with any deterrent technology, and any other combinations thereof depending on a specific need or application.

Generally, the sheet of durable material extends between a perimeter of each panel. In some instances, a ballistic resistant panel and/or other ballistics resistant grade materials or combinations thereof can be used. Generally, sheets of durable material can generally be fabricated into rectangular-shaped sections designed to quickly mount to and/or between the respective perimeter components of the various panels to create a desired protection level for the apparatus 100. The sheets of durable materials can be affixed to the various panels and/or frame 100 using conventional methodologies including, but not limited to, nuts-and-bolts, rivets, or other products suitable for specific need or application.

As shown in FIGS. 1-3, a leading handle 120 can be provided for a user to manually grip at least one of the panels, such as a leading panel 106, to pull some or all of the adjacent connected one or more intermediate panels 110, 112 outward from the trailing panel 102. As the user continues pulling the leading handle 120, the leading panel 106 and any adjacent connected one or more intermediate panels 110, 112 can articulate and/or telescope outward and away from the trailing panel 102 to position the leading panel 106 and any adjacent connected one or more intermediate panels 110, 112 of the apparatus 100 in a deployed configuration, as seen in FIGS. 4-6. A protective barrier can be created by manually pulling on the leading handle 120 of the leading panel 106 positioned adjacent the trailing panel 102, and one or more intermediate panels 110, 112, when the apparatus 100 is in a stored or non-deployed position as shown in FIGS. 1-3.

In some instances, one or more handles, similar to 118, 120, can be embedded and/or mounted to some or all of the adjacent connected one or more intermediate panels 110, 112. Such handles can be telescoping and/or articulating handles, or pull loops, that can be made from the same material as the panel components, panel material or skins, or any other material disclosed herein depending on a desired need or application.

Turning to use and/or deployment of the apparatus 100, FIGS. 4-6 illustrate views of the mobile expandable ballistic barrier apparatus of FIGS. 1-3, in an activated or deployed configuration, according to an example embodiment of the disclosure. FIG. 4 illustrates a front view of the apparatus, and FIG. 5 illustrates a rear view of the apparatus shown in FIGS. 1-3, in an activated or deployed configuration. FIG. 6 illustrates a side view of the apparatus shown in FIGS. 4-5.

Similar to FIGS. 1-3, as shown in FIGS. 4-6, the apparatus 100 can include a trailing panel 102, one or more intermediate panels 110, 112, and a leading panel 106. The leading panel 106 can telescope in a first direction 130 outward and away from the trailing panel 102, and the one more intermediate panels 110, 112 can also telescope in the same first direction 130 outward and away from the trailing panel 102. Alternatively, the trailing panel 102 can telescope in an opposing direction 132 outward and away from the leading panel 106, and the one more intermediate panels 110, 112 can also telescope in the opposing direction 132 outward and away from the leading panel 102. In any instance, each of the panels can be configured to slide with respect to the respective adjacent and connected panels along respective guide mechanisms 126, 128, detailed further in FIG. 7.

As needed, in certain embodiments, one or more additional intermediate panels, similar to 110, 112 can mount to an outward leading or trailing side of an adjacent intermediate panel. The additional intermediate panels can slide, telescope, or otherwise translate as needed to extend in a first direction 130 outward and away from the adjacent connected intermediate panel, or, may extend in an opposing direction 132 outward and away from another adjacent connected intermediate panel. In some instances, the additional one or more intermediate panels can be configured to rotate and extend with respect to an adjacent connected intermediate panel and via respective one or more hinge mechanisms. In any manner, the protective barrier formed by an apparatus 100 in a deployed configuration can be extended as needed.

Further, an apparatus 100 can be retrofitted at any point with any number of different configurations, such as different protection degrees for some or all of the panels and/or apparatus 100. In one example, some or all of the panels and/or apparatus 100 can include microwave and/or frequency energy wave absorbing materials to protect a user from microwave and/or frequency energy weapons. In any instance, any number of security enhancements can be utilized with the apparatus 100 including mounting a series of sharp devices, on an upper lateral surface of each of the first intermediate panel, second intermediate panel, one or more telescoping panels, one or more lead folding panels, and one or more extension folding panels. These sharp devices can be spike-shaped, or designed to deter a person from attempting to climb over or otherwise mounting an upper surface of the apparatus 100 when in a deployed configuration. Further, one or more openings, such as 134, through some or all of the panels, can function as gun ports that can facilitate aiming and/or discharging a firearm through the respective panel and/or apparatus 100. Further, one or more movable kick plates, such as 136, can be mounted on a lower portion of some or all of the panels to facilitate protecting the feet or lower extremities of users positioned on the rear side of the panels and/or apparatus 100 from incoming projectiles such as firearm rounds and/or or shrapnel. Moreover, an apparatus 100 can also include a sound machine and/or a high intensity LED light bar, or mounts for a sound machine and/or light bar, for strobe and blinding effects on some or more panels.

FIG. 7 illustrates a detailed view illustrating an example guide mechanism of the apparatus shown in FIGS. 1-6, according to an example embodiment of the disclosure. In this example, a frame guide or horizontal track 700 is mounted along a horizontal strut 702 and/or between adjacent perimeter components 704, 706 associated with an apparatus 100 and/or frame 104, 108 One or more block mounts 708 can be configured with a respective groove 710 to permit each block mount 708 to mount to a corresponding structure 712 on the track 700. When the block mount 708 is mounted to the corresponding structure 712, the weight of the block mount 712 is loaded or otherwise cantilevered on the track 700 by way of the interaction between the groove 710 of the block mount on the corresponding structure 712 of the track 700. A panel 714, such as a first intermediate panel 110 or second intermediate panel 112, can connect to the block mounts 708 using a series of connectors, such as machine bolts or mounting screws. In some instances, a block mount such as 708 and/or groove 710 can be an integral part of or otherwise formed on the panel 714, and the corresponding structure 712 and frame guide or horizontal track 700 can be an integral part of or otherwise formed on the apparatus 100 and/or frame 104, 108. In this manner, some or all of the weight of the panel 714, such as a first intermediate panel or second intermediate panel, can also transfer to and be supported by the track 700, and permit the panel 714 to slide along the frame guide or track 700 with respect to the apparatus 100 and/or frame 104, 108.

Figure 8:
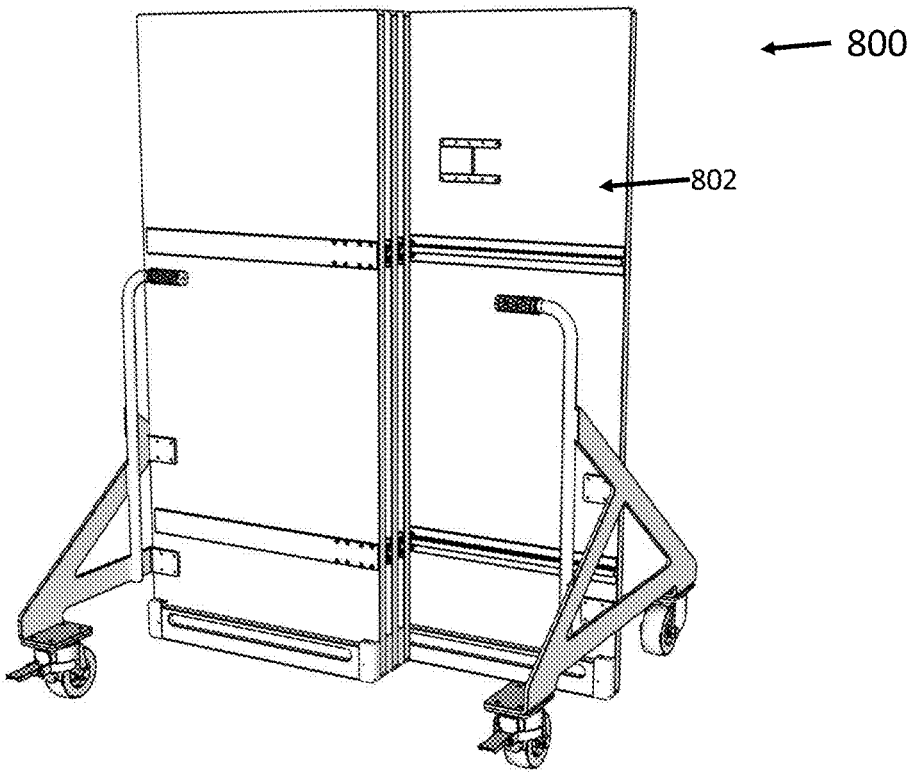
FIG. 8 is a rear perspective view of the apparatus shown in FIGS. 1-6, in a "2wide" configuration, according to an example embodiment of the disclosure.

FIG. 8 is a perspective rear view of the apparatus shown in FIGS. 1-6, in a "2wide" configuration, according to an example embodiment of the disclosure. In this embodiment, the apparatus 800 is in a 2wide configuration, which can be a fully open or deployed configuration. In this configuration, the apparatus 800 can form an extended or protective barrier 802 that is about two panels or less wide, which may be the width of a hallway, corridor, or building space that the apparatus 800 is being deployed in. When a user, such a SWAT team operator deploys the apparatus 800 from a closed or non-deployed configuration, such as in FIGS. 1-3, to a 2wide configuration shown in FIG. 8, the user may push a button or other mechanism to facilitate releasing the position of the leading panel 802 to telescope, slide, or otherwise extend away from the trailing panel 804 and the one or more adjacent connected intermediate panels 806, 808. When the desired position of the leading panel 802 is reached, the position of the panels in the apparatus 800 can be fixed or otherwise locked via a locking mechanism to cease closing or opening the panels of the apparatus 800. The locking mechanism can be a stopper-type device that can be depressed or otherwise manipulated by a user, such as one or more pulled or inserted tethered collar pins, or a pull down lever for each panel. The apparatus 800, in the 2wide configuration, can then be further deployed by manipulating the apparatus 800 so that a user or users can move freely and/or engage hostile targets, etc. One skilled in the art will recognize the various configurations for the apparatus that can be created in accordance with certain embodiments of the disclosure.

Figure 9:
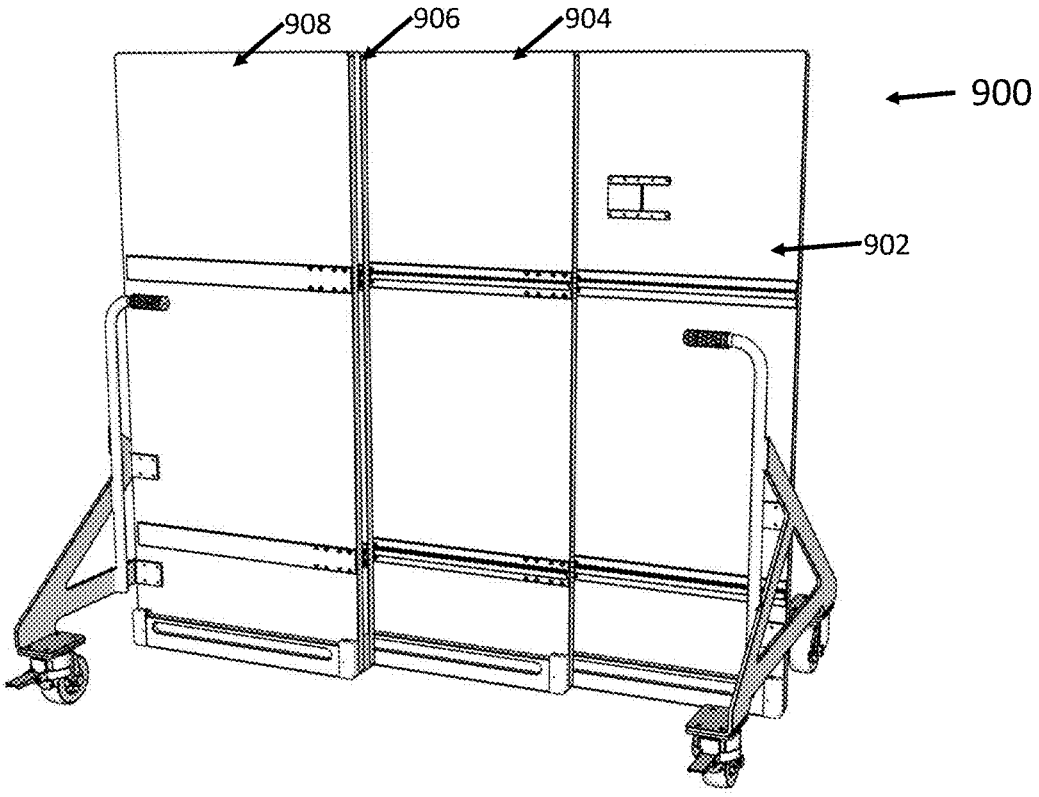
FIG. 9 is a rear perspective view of the apparatus shown in FIGS. 1-6, in a "3wide" configuration, according to an example embodiment of the disclosure.

FIG. 9 is a perspective rear view of the apparatus shown in FIGS. 1-6, in a "3wide" configuration, according to an example embodiment of the disclosure. In this embodiment, the apparatus 900 is in a 3wide configuration, which can be a fully open or deployed configuration. In this configuration, the apparatus 900 can form an extended or protective barrier 902 that is about three panels or less wide, which may be the width of a hallway, corridor, or building space that the apparatus 900 is being deployed in. When a user, such a SWAT team operator deploys the apparatus 900 from a closed or non-deployed configuration, such as in FIGS. 1-3, to a 3wide configuration shown in FIG. 9, the user may push a button or other mechanism to facilitate releasing the position of the leading panel 902 and a first intermediate panel 904 to telescope, slide, or otherwise extend away from the trailing panel 906 and the one or more other adjacent connected intermediate panels 908. When the desired position of the leading panel 902 is reached, the position of the panels in the apparatus 900 can be fixed or otherwise locked via a locking mechanism to cease closing or opening the panels of the apparatus 900. The locking mechanism can be a stopper-type device that can be depressed or otherwise manipulated by a user, such as one or more pulled or inserted tethered collar pins, or a pull down lever for each panel. The apparatus 900, in the 3wide configuration, can then be further deployed by manipulating the apparatus 900 so that a user or users can move freely and/or engage hostile targets, etc. One skilled in the art will recognize the various configurations for the apparatus that can be created in accordance with certain embodiments of the disclosure.

Figure 10A:
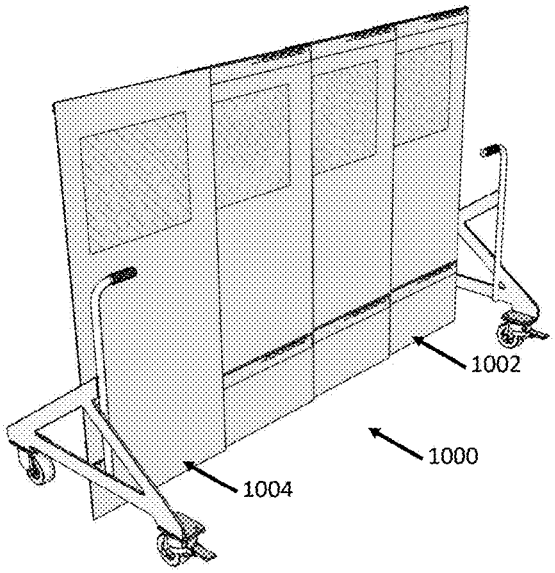
FIGS. 10A and 10B illustrate respective rear and front perspective views of another configuration of an apparatus, in accordance with an example embodiment of the disclosure.
Figure 10B:
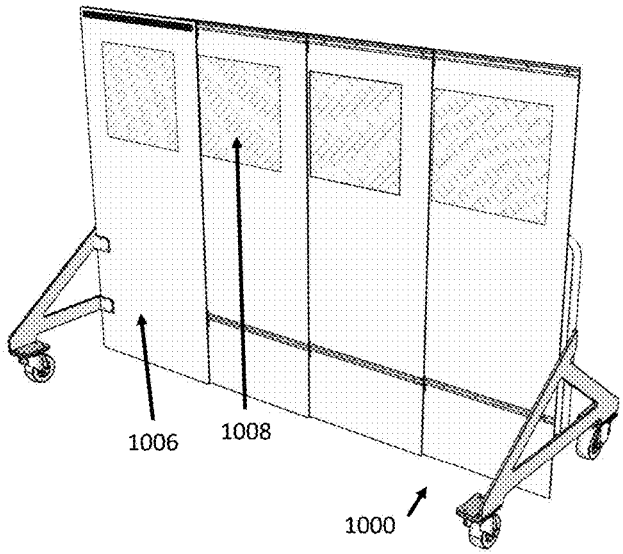

FIGS. 10A and 10B illustrate respective rear and front perspective views of another configuration of an apparatus, in accordance with an example embodiment of the disclosure. FIG. 10A shows a rear side perspective view of the apparatus 1000, and FIG. 10B shows a front side perspective view of the apparatus 1000, in an open or deployed configuration. In the configuration shown in FIGS. 10A and 10B, a protective barrier 1002 is formed by the extension, sliding, or telescoping of the various panels with respect to a trailing panel 1004. In the configuration shown, the apparatus 1000 can be retrofitted with a combination of kevlar, fiberglass, resin meta material or as shown ballistic steel plates 1006, one or more windows 1008, and a relatively thinner profile. For example, the overall width dimension of the apparatus 1000 can be about 15 inches (0.38 meters), and each panel can be less than an inch thick (0.03 meters) wide. In any instance, the apparatus 1000 shown can also include one or more optional deployment mechanisms, such as track bars, pushing rods, cables, air compression, hydraulic fluid systems, friction motors, embedded slot sliders, coiled springs, rollers, pulley cable, and crank gears.

Figure 11:
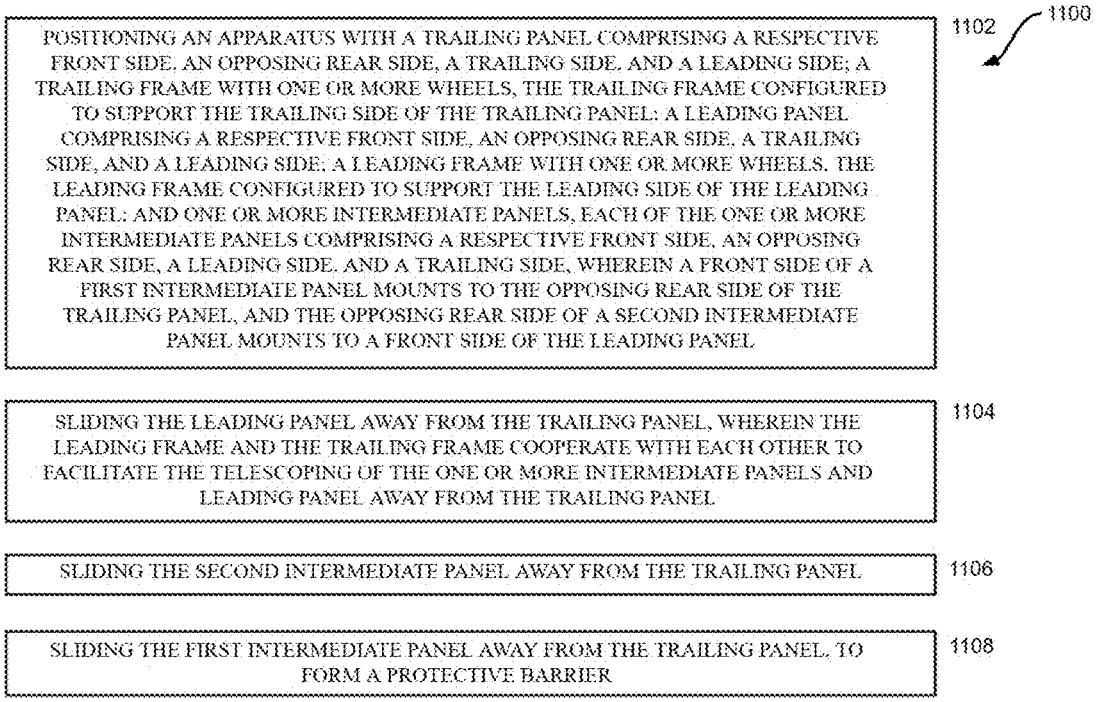
FIG. 11 illustrates a flowchart of an example process to install or deploy the example apparatus of FIGS. 1-6, according to an example embodiment of the disclosure.

FIG. 11 illustrates a flowchart of an example process to install or deploy the apparatus of FIGS. 1-6, according to an example embodiment of the disclosure. In the embodiment shown in FIG. 11, a method 1100 starts at block 1102. At block 1102, the method can include positioning the apparatus comprising a trailing panel comprising a respective front side, an opposing rear side, a trailing side, and a leading side; a trailing frame with one or more wheels, the trailing frame configured to support the trailing side of the trailing panel; a leading panel comprising a respective front side, an opposing rear side, a trailing side, and a leading side; a leading frame with one or more wheels, the leading frame configured to support the leading side of the leading panel; and one or more intermediate panels, each of the one or more intermediate panels comprising a respective front side, an opposing rear side, a leading side, and a trailing side, wherein a front side of a first intermediate panel mounts to the opposing rear side of the trailing panel, and the opposing rear side of a second intermediate panel mounts to a front side of the leading panel; wherein, in a storage or non-deployed position, the leading sides and the trailing sides of the leading panel, the trailing panel, and the one or more intermediate panels are substantially parallel and coplanar with each other. Block 1102 is followed by block 1104, wherein the method can include sliding or extending the leading panel away from the trailing panel, wherein the leading frame and the trailing frame cooperate with each other to facilitate the telescoping of the one or more intermediate panels and leading panel away from the trailing panel. Block 1104 is followed by block 1106, wherein the method can include sliding or extending the second intermediate panel away from the trailing panel. Block 1106 is followed by block 1108, wherein the method can include sliding or extending the first intermediate panel away from the trailing panel, to form a protective barrier. One skilled in the art will recognize that the method can have a fewer or greater number of operations.

While the systems, methods, and apparatus have been described in connection with certain embodiments and specific examples, it is not intended that the scope be limited to the particular embodiments set forth, as the embodiments herein are intended in all respects to be illustrative rather than restrictive. Further, unless otherwise expressly stated, it is in no way intended that any method set forth herein be construed as requiring that its operations be performed in a specific order. Accordingly, where a method claim does not actually recite an order to be followed by its operations or it is not otherwise specifically stated in the claims or descriptions that the operations are to be limited to a specific order, it is in no way intended that an order be inferred, in any respect. This holds for any possible non-express basis for interpretation, including: matters of logic with respect to arrangement of operations or operational flow; plain meaning derived from grammatical organization or punctuation; the number or type of embodiments described in the specification.

It will be apparent to those skilled in the art that various modifications and variations can be made without departing from the scope of the disclosure. Other embodiments will be apparent to those skilled in the art from consideration of the specification and practice disclosed herein. It is intended that the specification and examples be considered as exemplary only, with the scope of the disclosure being indicated by the following claims.

That which is claimed is:

1. A mobile expandable ballistic barrier apparatus comprising:

a trailing panel comprising a respective front side, an opposing rear side, a trailing side, and a leading side;

a trailing frame with one or more wheels, the trailing frame configured to support the trailing side of the trailing panel;

a leading panel comprising a respective front side, an opposing rear side, a trailing side, and a leading side;

a leading frame with one or more wheels, the leading frame configured to support the leading side of the leading panel; and one or more intermediate panels, each of the one or more intermediate panels comprising a respective front side, an opposing rear side, a leading side, and a trailing side, wherein a front side of a first intermediate panel mounts to the opposing rear side of the trailing panel, and the opposing rear side of a second intermediate panel mounts to a front side of the leading panel;

wherein, in a storage or non-deployed position, the respective leading sides and the trailing sides of the leading panel, the trailing panel, and the one or more intermediate panels are substantially parallel and coplanar with each other.

2. The apparatus of claim 1, wherein, in a deployed position, the leading frame and the trailing frame cooperate with each other to facilitate telescoping of the one or more intermediate panels and leading panel away from the trailing panel.

3. The apparatus of claim 1, further comprising a trailing handle operable to permit the trailing frame and trailing panel to be manually positioned via a force on the trailing handle.

4. The apparatus of claim 1, further comprising a leading handle operable to permit the leading frame and leading panel to be manually positioned via a force on the leading handle.

5. The apparatus of claim 1, wherein the first intermediate panel and second intermediate panel are operable to slide along one or more frame guides respectively associated with the trailing panel and leading panel.

6. The apparatus of claim 1, wherein the one or more wheels of the leading panel are mounted on a swivel-type mechanism.

7. The apparatus of claim 1, further comprising at least one panel with a translucent or clear material to facilitate viewing through the panel from at least one side.

8. The apparatus of claim 1, wherein each of the respective front sides of the trailing panel, the first intermediate panel, the second intermediate panel, and the leading panel comprise a ballistics resistant material.

9. A method for installing a mobile expandable ballistic barrier apparatus, the method comprising:

positioning an apparatus with:

a trailing panel comprising a respective front side, an opposing rear side, a trailing side, and a leading side;

a trailing frame with one or more wheels, the trailing frame configured to support the trailing side of the trailing panel;

a leading panel comprising a respective front side, an opposing rear side, a trailing side, and a leading side;

a leading frame with one or more wheels, the leading frame configured to support the leading side of the leading panel; and one or more intermediate panels, each of the one or more intermediate panels comprising a respective front side, an opposing rear side, a leading side, and a trailing side, wherein a front side of a first intermediate panel mounts to the opposing rear side of the trailing panel, and the opposing rear side of a second intermediate panel mounts to a front side of the leading panel;

wherein, in a storage or non-deployed position, the respective leading sides and the trailing sides of the leading panel, the trailing panel, and the one or more intermediate panels are substantially parallel and coplanar with each other;

sliding the leading panel away from the trailing panel, wherein the leading frame and the trailing frame cooperate with each other to facilitate telescoping of the one or more intermediate panels and leading panel away from the trailing panel;

sliding the second intermediate panel away from the trailing panel; and sliding the first intermediate panel away from the trailing panel, to form a protective barrier.

10. A system comprising:

two or more mobile expandable ballistic barrier apparatus, each apparatus comprising:

a trailing panel comprising a respective front side, an opposing rear side, a trailing side, and a leading side;

a trailing frame with one or more wheels, the trailing frame configured to support the trailing side of the trailing panel;

a leading panel comprising a respective front side, an opposing rear side, a trailing side, and a leading side;

a leading frame with one or more wheels, the leading frame configured to support the leading side of the leading panel; and one or more intermediate panels, each of the one or more intermediate panels comprising a respective front side, an opposing rear side, a leading side, and a trailing side, wherein a front side of a first intermediate panel mounts to the opposing rear side of the trailing panel, and the opposing rear side of a second intermediate panel mounts to a front side of the leading panel;

wherein a first mobile expandable ballistic barrier apparatus is operable to connect to a second mobile expandable ballistic barrier apparatus, when the one or more intermediate panels are fully telescoped away from their respective leading panels and trailing panels, and the leading panel of the first apparatus and trailing panel of the second apparatus are closely adjacent to each other.

* * * * *